US007520976B2

(12) United States Patent
Miller et al.

(10) Patent No.: US 7,520,976 B2
(45) Date of Patent: Apr. 21, 2009

(54) MULTIGRADE ENGINE OIL PREPARED FROM FISCHER-TROPSCH DISTILLATE BASE OIL

(75) Inventors: Stephen J. Miller, San Francisco, CA (US); John M. Rosenbaum, Richmond, CA (US); Susan M. Abernathy, Hercules, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 494 days.

(21) Appl. No.: 10/949,779

(22) Filed: Sep. 23, 2004

(65) Prior Publication Data

US 2006/0027486 A1 Feb. 9, 2006

Related U.S. Application Data

(60) Provisional application No. 60/599,665, filed on Aug. 5, 2004.

(51) Int. Cl.
*C10M 101/02* (2006.01)
*C10M 143/00* (2006.01)

(52) U.S. Cl. ..... 208/19; 208/950; 508/110; 508/591

(58) Field of Classification Search ..... 208/19
See application file for complete search history.

(56) References Cited

U.S. PATENT DOCUMENTS 4,812,246 A 3/1989 Yabe
4,906,350 A 3/1990 Lucien et al.
6,096,940 A 8/2000 Wittenbrink et al.
6,165,949 A 12/2000 Berlowitz et al.
6,332,974 B1 12/2001 Wittenbrink et al.
6,475,960 B1 11/2002 Berlowitz et al.
6,703,353 B1 * 3/2004 Lok et al. ..... 508/110
7,018,525 B2 3/2006 Miller et al.
7,045,055 B2 * 5/2006 Ziemer et al. ..... 208/18
7,053,254 B2 5/2006 Miller
7,083,713 B2 * 8/2006 Abernathy et al. ..... 208/18
7,141,157 B2 * 11/2006 Rosenbaum et al. ..... 208/18
7,144,497 B2 * 12/2006 Lok et al. ..... 208/18
7,195,706 B2 * 3/2007 Abernathy et al. ..... 208/18

OTHER PUBLICATIONS

John S. Manka and Kim L. Ziegler, "Factors affecting performance of crude oil wax-control additives", World Oil / Jun. 2001, pp. 75-81.

* cited by examiner

*Primary Examiner*—Ellen M McAvoy
(74) *Attorney, Agent, or Firm*—A. Stephen Zavell

(57) ABSTRACT

A multigrade engine oil meeting the specifications for SAE J300 revised June 2001 requirements and a process for preparing it, said engine oil comprising (a) between about 15 to about 94.5 wt % of a hydroisomerized distillate Fischer-Tropsch base oil characterized by (i) a kinematic viscosity between about 2.5 and about 8 cSt at 100° C., (ii) at least about 3 wt % of the molecules having cycloparaffin functionality, and (iii) a ratio of weight percent molecules with monocycloparaffin functionality to weight percent of molecules with multicycloparaffin functionality greater than about 15; (b) between about 0.5 to about 20 wt % of a pour point depressing base oil blending component prepared from an hydroisomerized bottoms material having an average degree of branching in the molecules between about 5 and 9 alkyl-branches per 100 carbon atoms and wherein not more than 10 wt % boils below about 900° F.; and (c) between about 5 to about 30 wt % of an additive package designed to meet the specifications for ILSAC GF-3.

36 Claims, No Drawings

MULTIGRADE ENGINE OIL PREPARED FROM FISCHER-TROPSCH DISTILLATE BASE OIL

CROSS REFERENCE TO RELATED APPLICATIONS

This Application claims priority from U.S. Provisional Application No. 60/599,665 filed Aug. 5, 2004.

This patent application also is related to co-pending U.S. patent application Ser. No. 10/704,031 filed Nov. 7, 2003, titled "Process for Improving the Lubricating Properties of Base Oils Using a Fischer-Tropsch Derived Bottoms" and Ser. No. 10/839,396 filed May 4, 2004, titled "Process for Improving the Lubricating Properties of Base Oils Using Isomerized Petroleum Product" the entire contents of both applications being incorporated herein by reference.

FIELD OF THE INVENTION

The present invention relates to a multigrade engine oil prepared from a Fischer-Tropsch distillate base oil that is capable of meeting the specifications for ILSAC GF-3 or GF-4 and the SAE J300 revised June 2001 requirements for MRV TP-1 prepared by blending the Fischer-Tropsch base oil with a pour point depressing base oil blending component and an additive package meeting ILSAC GF-3 or GF-4 requirements.

BACKGROUND OF THE INVENTION

Engine oils are finished crankcase lubricants intended for use in automobile engines and diesel engines and consist of two general components; a lubricating base oil and additives. Lubricating base oil is the major constituent in these finished lubricants and contributes significantly to the properties of the engine oil. In general, a few lubricating base oils are used to manufacture a variety of engine oils by varying the mixtures of individual lubricating base oils and individual additives.

Numerous governing organizations, including Original Equipment Manufacturers (OEM's), the American Petroleum Institute (API), Association des Consructeurs d' Automobiles (ACEA), the American Society of Testing and Materials (ASTM), International Lubricant Standardization and Approval Committee (ILSAC), and the Society of Automotive Engineers (SAE), among others, define the specifications for lubricating base oils and engine oils. Increasingly, the specifications for engine oils are calling for products with excellent low temperature properties, high oxidation stability, and low volatility. Currently, only a small fraction of the base oils manufactured today are able to meet these demanding specifications.

Lubricating base oils are petroleum derived or synthetic hydrocarbons having a viscosity of about 2.5 cSt or greater at 100° C., preferably about 4 cSt or greater at 100 C; a pour point of about 9 C or less, preferably about −15 C or less; and a VI (viscosity index) that is usually about 90 or greater, preferably about 100 or greater. Premium base oils will have a VI of at least 120. Lubricating base oils intended for preparing finished lubricants should have a Noack volatility no greater than current conventional Group I or Group II light neutral oils.

The term "base oil" refers to a hydrocarbon product having the above properties prior to the addition of additives. Base oils are generally recovered from the higher boiling fractions recovered from the vacuum distillation operation. They may be prepared from either petroleum-derived or from syncrude-derived feedstocks. "Additives" are chemicals which are added to improve certain properties in the finished lubricant so that it meets the minimum performance standards for the grade of the finished lubricant. For example, additives added to the engine oils may be used to improve stability of the lubricant, lower its viscosity, raise the viscosity index, and control deposits. Additives are expensive and may cause miscibility problems in the finished lubricant. For these reasons, it is generally desirable to lower the additive content of the engine oils to the minimum amount necessary to meet the appropriate requirements.

There are two principal categories of engine oil additives: DI additive packages (Detergent Inhibitor additive packages) and VI improvers (Viscosity Index improvers). DI additive packages serve to suspend oil contaminants and combustion by-products as well as to prevent oxidation of the oil with the resultant formation of varnish and sludge deposits. VI improvers modify the viscometric characteristics of lubricants by reducing the rate of thinning with increasing temperature and the rate of thickening with low temperatures. VI improvers thereby provide enhanced performance at low and high temperatures. In many multigrade engine oil applications VI improvers have to be used with DI additive packages. Engine oil additive packages are available from additive suppliers. Additive packages are formulated such that, when they are blended with a base oil or base oil blend having the desired properties, the resulting engine oil is likely to meet a specified engine oil service category. Specific engine oil service categories that are used, or being developed, today include ILSAC GF-3, ILSAC GF-4, API CI-4, and API PC-10.

The minimum specifications for the various viscosity grades of engine oils is established by SAE J300 standards as revised in June 2001. Base oils prepared from products made by the Fischer-Tropsch synthesis reaction are characterized by a very low sulfur content and excellent stability making them excellent candidates for blending into high quality finished lubricants. Unfortunately, finished lubricants blended from Fischer-Tropsch derived base oils generally display poor low temperature properties, particularly low temperature pumpability. Consequently, Fischer-Tropsch derived base oils have had difficulty passing the stringent mini-rotary viscometer (MRV) TP-1 viscosity specifications under SAE J300 as revised 2001.

ILSAC GF-3 refers to an engine oil service category of automotive gasoline engines. This specification became official on Jul. 1, 2001. ILSAC GF-4 refers to a new engine oil service category of automotive gasoline engines that was approved on Jan. 8, 2004. It became official on Jul. 1, 2004. This category introduces new sulfur limits measured by standard test method ASTM D 1552. The maximum sulfur limit for 0W-XX and 5W-XX oils is 0.5 wt %. The maximum sulfur limit for 10W-XX oils is 0.7 wt %. An engine oil meeting GF-4 requirements will also meet GF-3 requirements, but an engine oil meeting GF-3 requirements may not meet the requirements for a GF-3 engine oil.

A multigrade engine oil refers to an engine oil that has viscosity/temperature characteristics which fall within the limits of two different SAE numbers in SAE J300. The present invention is directed to the discovery that multigrade engine oils meeting the specifications under SAE J300 as revised 2001, including the MRV TP-1 viscosity specifications, may be prepared from Fischer-Tropsch base oils having a defined cycloparaffin functionality when they are blended with a pour point depressing base oil blending component and an additive package.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

BRIEF DESCRIPTION OF THE INVENTION

The present invention is directed to a multigrade engine oil meeting the specifications for SAE J300 revised June 2001, said engine oil comprising (a) between about 15 to about 94.5 wt % of a hydroisomerized distillate Fischer-Tropsch base oil characterized by (i) a kinematic viscosity between about 2.5 and about 8 cSt at 100° C., (ii) at least about 3 wt % of the molecules having cycloparaffin functionality, and (iii) a ratio of weight percent molecules with monocycloparaffin functionality to weight percent of molecules with multicycloparaffin functionality greater than about 15; (b) between about 0.5 to about 20 wt % of a pour point depressing base oil blending component prepared from an hydroisomerized bottoms material having an average degree of branching in the molecules between about 5 and about 9 alkyl-branches per 100 carbon atoms and wherein not more than 10 wt % boils below about 900° F.; and (c) between about 5 to about 30 wt % of an additive package designed to meet the specifications for ILSAC GF-3. Using the present invention, multigrade engine oils may be prepared meeting the specifications for SAE viscosity grade 0W-XX, 5W-XX, or 10W-XX engine oil, wherein XX represents the integer 20, 30, or 40. A multigrade engine oil meeting the specifications for SAE 0W-20 may be prepared according to the present invention.

The present invention is also directed to a process for preparing a multigrade engine oil meeting the specifications for SAE J300 revised June 2001 which comprises (a) hydroisomerizing a waxy Fischer-Tropsch base oil in an isomerization zone in the presence of a hydroisomerization catalyst and hydrogen under pre-selected conditions determined to provide a hydroisomerized Fischer-Tropsch base oil product; (b) recovering from the isomerization zone a hydroisomerized Fischer-Tropsch base oil product; (c) distilling the hydroisomerized Fischer-Tropsch base oil product recovered from the isomerization zone under distillation conditions pre-selected to collect a distillate Fischer-Tropsch base oil characterized by (i) a kinematic viscosity between about 2.5 and about 8 cSt at 100° C., (ii) at least about 3 wt % of the molecules having cycloparaffin functionality, and (iii) a ratio of weight percent molecules with monocycloparaffin functionality to weight percent of molecules with multicycloparaffin functionality greater than about 15; (d) blending the distillate Fischer-Tropsch base oil with (i) a pour point depressing base oil blending component prepared from an hydroisomerized bottoms material having an average degree of branching in the molecules between about 5 and about 9 alkyl-branches per 100 carbon atoms and wherein not more than 10 wt % boils below about 900° F. and (ii) an additive package designed to meet the specifications for ILSAC GF-3 in the proper proportions to yield a multigrade engine oil meeting the specifications for SAE J300 revised June 2001. Preferably the hydroisomerized distillate base oil fraction is also hydrofinished prior to the blending step (c) to reduce both any aromatics and olefins present to a low level.

The pour point depressing base oil blending component may be prepared from the bottoms fraction from either a petroleum-derived or a Fischer-Tropsch derived product. If the pour point depressing base oil blending component is an isomerized petroleum derived bottoms product, it preferably will have an average molecular weight of at least 600. If the pour point depressing base oil blending component is a hydroisomerized Fischer-Tropsch derived bottoms product, it will preferably have a molecular weight between about 600 and about 1,100.

DETAILED DESCRIPTION OF THE INVENTION

The SAE J300 specifications (revised June 2001) for engine oil are detailed in Table 1 below.

TABLE 1*

| SAE Viscosity Grade | High Temperature High Shear Rate Viscosity at 150° C. (cP), Min | Viscosity (cP) at Temperature (° C.), Max: CCS | Viscosity (cP) at Temperature (° C.), Max: MRV TP-1 w/ No Yield Stress | Kinematic Viscosity mm2/s (cSt) at 100° C.: Min | Kinematic Viscosity mm2/s (cSt) at 100° C.: Max |
|---|---|---|---|---|---|
| 0W | — | 6,200 at −35 | 60,000 at −40 | 3.8 | — |
| 5W | — | 6,600 at −30 | 60,000 at −35 | 3.8 | — |
| 10W | — | 7,000 at −25 | 60,000 at −30 | 4.1 | — |
| 15W | — | 7,000 at −20 | 60,000 at −25 | 5.6 | — |
| 20W | — | 2,500 at −15 | 60,000 at −20 | 5.6 | — |
| 25W | — | 13,000 at −10 | 60,000 at −15 | 9.3 | — |
| 20 | 2.6 | — | — | 5.6 | <9.3 |
| 30 | 2.9 | — | — | 9.3 | <12.5 |
| 40 | 2.9 (0W-40, 5W-40 and 10W-40 grades) 3.7 (15W-40, 20W-40 and 25W-40 grades) | — | — | 12.5 | <16.3 |
| 50 | 3.7 | — | — | 16.3 | <21.9 |
| 60 | 3.7 | — | — | 21.9 | <26.1 |

*Notes
1 cP = 1 centipoise = 1 mPa · s. This dynamic viscosity can be converted as follows: Dynamic Viscosity = Density × Kinematic Viscosity.
High Temperature High Shear Rate Viscosity is determined at 106 s-1 by ASTM D 4683, ASTM D 4741, or ASTM D 5481.
Cold Cranking Simulator Viscosity (CCS Vis) is determined by ASTM D 5293.
Mini-Rotary Viscometer (MRV) TP-1 Viscosity is determined by ASTM D 4684.
Kinematic Viscosity is determined by ASTM D 445.

Analytical Methods

Kinematic viscosity described in this disclosure was measured by ASTM D 445-01.

The cold-cranking simulator viscosity (CCS VIS) is a test used to measure the viscometric properties of lubricating base oils under low temperature and high shear. The test method to determine CCS VIS is ASTM D 5293-02. Results are reported in centipoise, cP. CCS VIS has been found to correlate with low temperature engine cranking. Specifications for maximum CCS VIS are defined for automotive engine oils by SAE J300 revised June 2001 as set out in Table 1, above.

High temperature high shear rate viscosity (HTHS) is a measure of a fluid's resistance to flow under conditions resembling highly-loaded journal bearings in fired internal combustion engines, typically 1 million s-1 at 150° C. HTHS is a better indication of how an engine operates at high temperature with a given lubricant than the kinematic low shear rate viscosities at 100° C. The HTHS value directly correlates to the oil film thickness in a bearing. SAE J300 June 2001 (see Table 1) contains the current specifications for HTHS measured by ASTM D 4683, ASTM D 4741, or ASTM D 5481. An SAE 20 viscosity grade engine oil, for example, is required to have a maximum HTHS of 2.6 centipoise (cP).

Mini-Rotary Viscometer (MRV TP-1) test is related to the mechanism of pumpability and is a low shear rate measurement that measured by standard test method ASTM D 4684. Slow sample cooling rate is the key feature of the method. A sample is pretreated to have a specified thermal history which includes warming, slow cooling, and soaking cycles. The MRV TP-1 measures an apparent yield stress, which, if greater than a threshold value, indicates a potential air-binding pumping failure problem. Above a certain viscosity (currently defined as 60,000 cP by SAE J300 June 2001), the oil may be subject to pumpability failure by a mechanism called "flow limited" behavior. An SAE 10W oil, for example, is required to have a maximum viscosity of 60,000 cP at −30° C. with no yield stress. This method also measures an apparent viscosity under shear rates of 1 to 50 s-1.

In addition to meeting the requirements for SAE J300 (revised June 2001), multigrade engine oils of the present invention may be formulated to meet the ILSAC GF-3 specifications, as well as the more stringent GF-4 specifications. Both GF-3 and GF-4 require a minimum Noack volatility value of 15. However, preferably the Noack volatility value of the finished lubricant will be 10 or less. Noack volatility as specified in ILSAC GF-3 and GF-4 uses standard test method ASTM D 5800. According to this method Noack is defined as the mass of oil, expressed in weight percent, which is lost when the oil is heated at 250° C. and 20 mmHg (2.67 kPa; 26.7 mbar) below atmospheric in a test crucible through which a constant flow of air is drawn for 60 minutes. A more convenient method for calculating Noack volatility and one which correlates well with ASTM D 5800 uses a thermo gravimetric analyzer test (TGA) by ASTM D 6375.

Pour point refers to the temperature at which the sample will begin to flow under carefully controlled conditions. In this disclosure, where pour point is given, unless stated otherwise, it has been determined by standard analytical method ASTM D 5950 or its equivalent. VI may be determined by using ASTM D 2270-93 (1998) or its equivalent. Molecular weight may be determined by ASTM D 2502, ASTM D 2503, or other suitable method. For use in association with this invention, molecular weight is preferably determined by ASTM D 2503-02. As used herein, an equivalent analytical method to the standard reference method refers to any analytical method which gives substantially the same results as the standard method.

The branching properties of the pour point depressing base oil blending component of the present invention was determined by analyzing a sample of oil using carbon-13 NMR according to the following seven-step process. References cited in the description of the process provide details of the process steps. Steps 1 and 2 are performed only on the initial materials from a new process.

1) Identify the CH branch centers and the $CH_3$ branch termination points using the DEPT Pulse sequence (Doddrell, D. T.; D. T. Pegg; M. R. Bendall, Journal of Magnetic Resonance 1982, 48, 323ff).
2) Verify the absence of carbons initiating multiple branches (quaternary carbons) using the APT pulse sequence (Patt, S. L.; J. N. Shoolery, Journal of Magnetic Resonance 1982, 46, 535ff).
3) Assign the various branch carbon resonances to specific branch positions and lengths using tabulated and calculated values (Lindeman, L. P., Journal of Qualitative Analytical Chemistry 43, 1971 1245ff; Netzel, D. A., et. al., Fuel, 60, 1981, 307ff).

EXAMPLES

| Branch | NMR Chemical Shift (ppm) |
|---|---|
| 2-methyl | 22.5 |
| 3-methyl | 19.1 or 11.4 |
| 4-methyl | 14.0 |
| 4 + methyl | 19.6 |
| Internal ethyl | 10.8 |
| Propyl | 14.4 |
| Adjacent methyls | 16.7 |

4) Quantify the relative frequency of branch occurrence at different carbon positions by comparing the integrated intensity of its terminal methyl carbon to the intensity of a single carbon (=total integral/number of carbons per molecule in the mixture). For the unique case of the 2-methyl branch, where both the terminal and the branch methyl occur at the same resonance position, the intensity was divided by two before doing the frequency of branch occurrence calculation. If the 4-methyl branch fraction is calculated and tabulated, its contribution to the 4+methyls must be subtracted to avoid double counting.
5) Calculate the average carbon number. The average carbon number may be determined with sufficient accuracy for lubricant materials by dividing the molecular weight of the sample by 14 (the formula weight of $CH_2$).
6) The number of branches per molecule is the sum of the branches found in step 4.
7) The number of alkyl branches per 100 carbon atoms is calculated from the number of branches per molecule (step 6)×100/average carbon number.

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0 to 80 ppm vs. TMS (tetramethylsilane). Solutions of 15 to 25 wt % in chloroform-d1 were excited by 45° pulses followed by a 0.8 second acquisition time. In order to minimize non-uniform intensity data, the proton decoupler was gated off during a 10 second delay prior to the excitation pulse and on during acquisition. Total experiment times ranged from 11 to 80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal all carbons bonded to protons. DEPT 90 shows CH carbons only. DEPT 135 shows CH and $CH_3$ up and $CH_2$ 180° out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. Both are described in the references cited. The branching properties of each sample were determined by C-13 NMR using the assumption in the calculations that the entire sample was iso-paraffinic. Corrections were not made for n-paraffins or naphthenes, which may have been present in the oil samples in varying amounts. The naphthenes content may be measured using Field Ionization Mass Spectroscopy (FIMS).

FIMS analysis was conducted by placing a small amount (about 0.1 mg.) of the base oil to be tested in a glass capillary tube. The capillary tube was placed at the tip of a solids probe for a mass spectrometer, and the probe was heated from about 50° C. to 600° C. at 100° C. per minute in a mass spectrometer operating at about 10-6 torr. The mass spectromer used was a Micromass Time-of-Flight mass spectrometer. The emitter was a Carbotec 5 um emitter designed for FI operation. A constant flow of pentaflourochlorobenzene, used as lock mass, was delivered into the mass spectrometer via a thin capillary tube. Response factors for all compound types were assumed to be 1.0, such that weight percent was given directly from area percent.

Since petroleum derived hydrocarbons and Fischer-Tropsch derived hydrocarbons comprise a mixture of varying molecular weights having a wide boiling range, this disclosure will refer to the 10% boiling point of the boiling range of the pour point depressing base oil blending component. The 10% boiling point refers to that temperature at which 10 wt % of the hydrocarbons present in the pour point depressing base oil blending component will vaporize at atmospheric pressure. Only the 10% boiling point is used when referring to the pour point depressing base oil blending component, since it is generally derived from a bottoms fraction which makes the upper boiling limit irrelevant for the purposes of defining the material. For samples having a boiling range above 1000° F., the boiling range distributions in this disclosure were measured using the standard analytical method ASTM D 6352 or its equivalent. For samples having a boiling range below 1000° F., the boiling range distributions in this disclosure were measured using the standard analytical method ASTM D 2887 or its equivalent.

Hydroisomerization

Hydroisomerization is intended to improve the cold flow properties of the Fischer-Tropsch base oil by the selective addition of branching into the molecular structure. Hydroisomerization is also used to prepare the pour point depressing base oil blending component. Hydroisomerization ideally will achieve high conversion levels of the wax to non-waxy iso-paraffins while at the same time minimizing the conversion by cracking. Preferably, the conditions for hydroisomerization in the present invention are controlled such that the conversion of the compounds boiling above about 700° F. in the wax feed to compounds boiling below about 700° F. is maintained between about 10 wt % and 50 wt %, preferably between 15 wt % and 45 wt %.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10-(or 11-or 12-) ring molecular sieves have 10 (or 11 or 12) tetrahedrally-coordinated atoms (T-atoms) joined by an oxygen atom. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Å, having a maximum crystallographic free diameter of not more than 7.1 and a minimum crystallographic free diameter of not less than 3.9 Å. Preferably the maximum crystallographic free diameter is not more than 7.1 Å and the minimum crystallographic free diameter is not less than 4.0 Å. Most preferably the maximum crystallographic free diameter is not more than 6.5 Å and the minimum crystallographic free diameter is not less than 4.0 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

A particularly preferred intermediate pore size molecular sieve, which is useful in the present process is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å.

The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40% or greater (isomerization selectivity is determined as follows: 100× (weight percent branched $C_{16}$ in product)/(weight percent branched $C_{16}$ in product+ weight percent $C_{13}$ in product)

when used under conditions leading to 96% conversion of normal hexadecane (n-$C_{16}$) to other species.

Such a particularly preferred molecular sieve may further be characterized by pores or channels having a crystallographic free diameter in the range of from about 4.0 Å to about 7.1 Å, and preferably in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp. 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al., J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5 at 25° C.). Intermediate pore size molecular sieves will typically admit molecules having kinetic diameters of 5.3 to 6.5 Å with little hindrance.

Hydroisomerization catalysts useful in the present invention comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 wt % of the total catalyst, usually from 0.1 to 2 wt %, and not to exceed 10 wt %.

The refractory oxide support may be selected from those oxide supports, which are conventionally used for catalysts, including silica, alumina, silica-alumina, magnesia, titania and combinations thereof.

The conditions for hydroisomerization will be tailored to achieve a Fischer-Tropsch derived lubricant base oil fraction comprising greater than 5 wt % molecules with cycloparaffinic functionality, and a ratio of weight percent of molecules with monocycloparaffinic functionality to weight percent of molecules with multicycloparaffinic functionality of greater than 15.

The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 550° F. to about 775° F. (288° C. to about 413° C.), preferably 600° F. to about 750° F. (315° C. to about 399° C.), more preferably about 600° F. to about 700° F. (315° C. to about 371° C.); and pressures from about 15 to 3,000 psig, preferably 100 to 2,500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr-1, preferably from about 0.1 to about 5 hr-1. Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone. Suitable conditions for performing hydroisomerization are described in U.S. Pat. Nos. 5,282,958 and 5,135,638, the contents of which are incorporated by reference in their entirety.

Hydrofinishing

Hydrofinishing operations are intended to improve the UV stability and color of the products. It is believed this is accomplished by saturating the double bonds present in the hydrocarbon molecule which also reduces the amount of both aromatics and olefins to a low level. In the present invention, hydroisomerized distillate base oil is preferably sent to a hydrofinisher prior to the blending step. A general description of the hydrofinishing process may be found in U.S. Pat. Nos. 3,852,207 and 4,673,487. As used in this disclosure the term UV stability refers to the stability of the lubricating base oil or other products when exposed to ultraviolet light and oxygen. Instability is indicated when a visible precipitate forms or darker color develops upon exposure to ultraviolet light and air which results in a cloudiness or floc in the base oil. Lubricating base oils used in the present invention generally will require UV stabilization before they are suitable for use in the manufacture of commercial lubricating oils.

In the present invention the total pressure in the hydrofinishing zone will be above 500 psig, preferably above 1,000 psig, and most preferably will be above 1,500 psig. The maximum total pressure is not critical to the process, but due to equipment limitations the total pressure will not exceed 3,000 psig and usually will not exceed about 2,500 psig. Temperature ranges in the hydrofinishing reactor are usually in the range of from about 300° F. (150° C.) to about 700° F. (370° C.), with temperatures of from about 400° F. (205° C.) to about 500° F. (260° C.) being preferred. The LHSV is usually within the range of from about 0.2 to about 2.0, preferably 0.2 to 1.5 and most preferably from about 0.7 to 1.0. Hydrogen is usually supplied to the hydrofinishing reactor at a rate of from about 1,000 to about 10,000 SCF per barrel of feed. Typically the hydrogen is fed at a rate of about 3,000 SCF per barrel of feed.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294; and 4,673,487.

The Hydroisomerized Distillate Fischer-Tropsch Base Oil

The separation of Fischer-Tropsch products is generally conducted by either atmospheric or vacuum distillation or by a combination of atmospheric and vacuum distillation. Atmospheric distillation is typically used to separate the lighter distillate fractions, such as naphtha and middle distillates, from a bottoms fraction having an initial boiling point above about 700° F. to about 750° F. (about 370° C. to about 400° C.). At higher temperatures thermal cracking of the hydrocarbons may take place leading to fouling of the equipment and to lower yields of the heavier cuts. Vacuum distillation is typically used to separate the higher boiling material, such as the distillate base oil fraction used in the present invention.

As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column.

The hydroisomerized distillate Fischer-Tropsch base oil used in the invention typically will contain very low sulfur, high VI, and excellent cold flow properties. Following the hydroisomerization step, the hydroisomerized distillate base oil is usually hydrofinished, which in addition to improving the UV stability of the base oil, also reduces the aromatics to a low level; preferably the aromatics will comprise less than about 0.3 wt %. Following the hydrofinishing step, the base oil will also contain low olefins; preferably in amounts below the detection level by long duration carbon-13 NMR.

Generally, the Fischer-Tropsch base oils will have a minimum kinematic viscosity at 100° C. of at least 2.5 cSt, preferably at least 3 cSt and more preferably at least 4 cSt, with an upper limit of about 8 cSt. The Fischer-Tropsch base oil will have a pour point below 20° C., preferably below −12° C., and a VI that is usually greater than 90, preferably greater than 100, even more preferably greater than 120.

The number of molecules of the hydroisomerized distillate Fischer-Tropsch base oil having cycloparaffinic functionality will be at least 5 wt %; preferably the number of molecules having cycloparaffinic functionality will be at least about 10 wt %. The hydroisomerized Fischer-Tropsch base oil will also have a ratio of weight percent of molecules with monocycloparaffinic functionality to weight percent of molecules with multicycloparaffinic functionality of greater than about 15, preferably greater than about 50. Both the total cycloparaffinic functionality and the ratio of monocycloparaffinic functionality to multicycloparaffinic functionality present in the base oil may be controlled by carefully selecting the operating conditions of the hydroisomerization step.

The viscosity index of the hydroisomerized distillate Fischer-Tropsch base oil will preferably be equal to or greater than a value calculated by the equation:

$$VI = 28 \times Ln(\text{kinematic viscosity at } 100^\circ \text{ C.}) + 95$$

Wherein: VI represents viscosity index

Ln represents the natural log.

The cold cranking simulator viscosity at −35° C. of the hydroisomerized distillate Fischer-Tropsch base oil preferably will be equal to or less than a value calculated by the equation:

$$CCS\ VIS(-35^\circ \text{ C.}) = 38 \times (\text{kinematic viscosity at } 100^\circ \text{ C.})^3$$

Wherein: CCS VIS(−35° C.) represents cold cranking simulator viscosity at −35° C.

Even more preferably the cold cranking simulator viscosity at −35° C. of the hydroisomerized distillate Fischer-Tropsch base oil will be equal to or less than a value calculated by the equation:

$$CCS\ VIS(-35^\circ \text{ C.}) = 38 \times (\text{kinematic viscosity at } 100^\circ \text{ C.})^{2.8}$$

Wherein: CCS VIS(−35° C.) represents cold cranking simulator viscosity at −35° C.

The Pour Point Depressing Base Oil Blending Component

The pour point depressing base oil blending component is usually prepared from the high boiling bottoms fraction remaining in the vacuum tower after distilling off the lower boiling base oil fractions. It will have a molecular weight of at least 600. It may be prepared from either a Fischer-Tropsch derived bottoms or a petroleum derived bottoms. The bottoms is hydroisomerized to achieve an average degree of branching in the molecule between about 5 and about 9 alkyl-branches per 100 carbon atoms. Following hydroisomerization the pour point depressing base oil blending component should have a pour point between about −20° C. and about 20° C., usually between about −10° C. and about 20° C. The molecular weight and degree of branching in the molecules are particularly critical to the proper practice of the invention.

In the case of Fischer-Tropsch syncrude, the pour point depressing base oil blending component is prepared from the waxy fraction that is normally a solid at room temperature. The waxy fraction may be produced directly from the Fischer-Tropsch syncrude or it may be prepared from the oligomerization of lower boiling Fischer-Tropsch derived olefins. Regardless of the source of the Fischer-Tropsch wax, it must contain hydrocarbons boiling above about 950° F. in order to produce the bottoms used in preparing the pour point depressing base oil blending component. In order to improve the pour point and VI, the wax is hydroisomerized to introduce favorable branching into the molecules. The hydroisomerized wax will usually be sent to a vacuum column where the various distillate base oil cuts are collected. In the case of Fischer-Tropsch derived base oil, these distillate base oil fractions may be used for the hydroisomerized Fischer-Tropsch distillate base oil. The bottoms material collected from the vacuum column comprises a mixture of high boiling hydrocarbons which are used to prepare the pour depressing base oil blending component. In addition to hydroisomerization and fractionation, the waxy fraction may undergo various other operations, such as, for example, hydrocracking, hydrotreating, and hydrofinishing. The pour point depressing base oil blending component of the present invention is not an additive in the normal use of this term within the art, since it is really only a high boiling base oil fraction.

The pour point depressing base oil blending component will have a pour point that is at least 3° C. higher than the pour point of the hydroisomerized Fischer-Tropsch distillate base oil. It has been found that when the hydroisomerized bottoms as described in this disclosure is used to reduce the pour point of the blend, the pour point of the blend will be below the pour point of both the pour point depressing base oil blending component and the hydroisomerized distillate Fischer-Tropsch base oil. Therefore, it is not necessary to reduce the pour point of the bottoms to the target pour point of the engine oil. Accordingly, the actual degree of hydroisomerization need not be as high as might otherwise be expected, and the hydroisomerization reactor may be operated at lower severity with less cracking and less yield loss. It has been found that the bottoms should not be over hydroisomerized or its ability to act as a pour point depressing base oil blending component will be compromised. Accordingly, the average degree of branching in the molecules of the Fischer-Tropsch bottoms should fall within the range of from about 5 to about 9 alkyl branches per 100 carbon atoms.

A pour point depressing base oil blending component derived from a Fischer-Tropsch feedstock will have an average molecular weight between about 600 and about 1,100, preferably between about 700 and about 1,000. The kinematic viscosity at 100° C. will usually fall within the range of from about 8 cSt to about 22 cSt. The 10% boiling point of the boiling range of the bottoms typically will fall between about 850° F. and about 1050° F. Generally, the higher molecular weight hydrocarbons are more effective as pour point depressing base oil blending components than the lower molecular weight hydrocarbons. Typically, the molecular weight of the pour point depressing base oil blending component will be 600 or greater. Consequently, higher cut points in the fractionation column which result in a higher boiling bottoms material are usually preferred when preparing the pour point depressing base oil blending component. The higher cut point also has the advantage of producing a higher yield of the distillate base oil fractions.

It has also been found that by solvent dewaxing the hydroisomerized bottoms material at a low temperature, generally −10° C. or less, the effectiveness of the pour point depressing base oil blending component may be enhanced. The waxy product separated during solvent dewaxing from the bottoms has been found to display improved pour point depressing properties provided the branching properties remain within the limits of the invention. The oily product recovered after the solvent dewaxing operation while displaying some pour point depressing properties is less effective than the waxy product.

In the case of being petroleum-derived, the basic method of preparation is essentially the same as already described above. Particularly preferred for preparing a petroleum derived pour point depressing base oil blending component is bright stock containing a high wax content. Bright stock constitutes a bottoms fraction which has been highly refined and dewaxed. Bright stock is a high viscosity base oil which is named for the SUS viscosity at 210° F. Typically petroleum derived bright stock will have a viscosity above 180 cSt at 40° C., preferably above 250 cSt at 40° C., and more preferably ranging from 500 to 1,100 cSt at 40° C. Bright stock derived from Daqing crude has been found to be especially suitable for use as the pour point depressing base oil blending component of the present invention. The bright stock should be hydroisomerized and may optionally be solvent dewaxed. Bright stock prepared solely by solvent dewaxing has been found to be much less effective as a pour point depressing base oil blending component.

The petroleum derived pour point depressing base oil blending component preferably will have a paraffin content of at least about 30 wt %, more preferably at least 40 wt %, and most preferably at least 50 wt %. The boiling range of the pour point depressing base oil blending component should be above about 950° F. (510° C.). The 10% boiling point should be greater than about 1050° F. (565° C.) with a 10% point in excess of 1150° F. (620° C.) being preferred. The average degree of branching in the molecules of the pour point depressing base oil blending component preferably will fall within the range of from about 6 to about 8 alkyl-branches per 100 carbon atoms.

Additive Package

Additive packages are intended to provide additives which provide desirable properties, such as, anti-fatigue, anti-wear, and extreme pressure properties, to the finished lubricant. The additive package which is blended into the multigrade engine oil should be designed to meet ILSAC GF-3 or GF-4 specifications. The specifications for GF-4 are similar to those for GF-3, although GF-4 requirements are more difficult to meet in certain tests. Therefore, any multigrade engine oil which meets GF-4 specifications will meet GF-3 as well. However, the reverse is not true. That is to say, not all multigrade engine oils which meet GF-3 specifications will pass GF-4. A number of commercial suppliers are available which offer GF-3 and GF-4 additive packages on the market. Two specific examples of commercially available GF-3 additive packages are Lubrizol LZ20000 (The Lubrizol Corporation) and Oloa 55006A (Chevron Oronite Company LLC). Although the commercially available additive packages are proprietary, U.S. Pat. Nos. 6,500,786 and 6,730,638 describe formulations intended to meet ILSAC GF-4 requirements for an additive package.

Zinc dialkyldithiophosphates (ZDDP) is an anti-wear additive which is a common component present in commercial additive packages, However, ZDDP gives rise to ash, which contributes to particulate matter in automotive exhaust emissions, and regulatory agencies are seeking to reduce emissions of zinc into the nvironment. In addition, phophorus, also a component of ZDDP, is suspected of limiting the service life of the catalytic converters that are used on cars to reduce ollution. It is desirable to limit the particulate matter and pollution formed during engine use for toxicological and environmental reasons, but it is also important to maintain undiminished the anti-wear properties of the lubricating oil. In view of the shortcoming of the known zinc and phosphorus containing additives, efforts have been made to reduce the amount of zinc and phosphorus present in the additive packages. Preferably, additive packages used in preparing the multigrade engine oils of the present invention will contain less than about 1.00 wt % zinc, expressed as elemental metal. The additive package will also preferably contain less than about 0.90 wt % phosphorus, expressed as elemental metal.

The Multigrade Engine Oil

A commercial multigrade engine oil refers to an engine oil that has viscosity/temperature characteristics which fall within the limits of two different SAE numbers in SAE J300 (see Table 1) and also meets either the ILSAC GF-3 or GF4 requirements, plus an API service category, such as SL (for gasoline-powered vehicles) or CI-4 (for diesel-powered vehicles). Europe has its own specification system, although they do incorporate some North American tests. The rest of the world mostly uses the North American system to some degree, although obsolete API service categories abound in developing countries. A multigrade engine oil within the scope of the present invention comprises between about 15 and about 94.5 wt % of the hydroisomerized distillate Fischer-Tropsch base oil, between about 0.5 to about 20 wt % of the pour point depressing base oil blending component, and between about 5 to about 30 wt % of the additive package. Generally, the multigrade engine oil blends of the invention will contain sufficient pour point depressing base oil blending component to reduce the pour point of the hydroisomerized distillate Fischer-Tropsch base oil by at least 2° C. In addition, the multigrade engine oil may optionally also contain other components or additives. For example, the multigrade engine oil may also contain from about 5 wt % to about 70 wt % of a polymerized olefin selected from at least one of a polyalphaolefin base oil, a polyinternalolefin base oil, or a mixture of polyalphaolefin and polyinternalolefin base oils. However, usually additional pour point depressants and/or viscosity index improvers are not necessary in formulations prepared according to this invention.

In blending the multigrade engine oil of the invention the order in which the various components are blended is not important. For example, when it is stated that sufficient pour point depressing base oil blending component should be present to reduce the pour point of the hydroisomerized distillate Fischer-Tropsch base oil by at least 2° C., it is not intended to intimate that the pour point depressing base oil blending component and the hydroisomerized distillate base oil must be blended together first and then the additive package blended in next. The intent is that the ratio of pour point depressing base oil blending component and hydroisomerized distillate Fischer-Tropsch base oil in the final blend should be such that if the two components were blended together without the additive package, the pour point of the hydroisomerized distillate Fischer-Tropsch base oil would be reduced by at least 2° C. The actual order in which the components are blended is irrelevant.

Multigrade engine oils within the scope of the invention may be formulated to meet the specifications for SAE viscosity grade 0W-XX, 5W-XX, or 10W-XX engine oil, wherein XX represents the integer 20, 30, or 40. Formulations meeting the specifications for SAE viscosity grade 0W-20 have been successfully prepared using the present invention. This requires that the MRV TP-1 of the formulation must have a result of 60,000 cP at −40° C. with no yield stress. Likewise, multigrade engine oils within the scope of the invention may be formulated with an MRV TP-1 result of 60,000 at temperatures of −35° C. and −30° C., respectively. Formulations with an MVR TP-1 result at −40° C. of 30,000 and 15,000 are also possible.

In order to meet the ILSAC GF-3 and GF-4 requirements a Noack volatility value of 15 as measured by standard test method ASTM D 5800 is necessary. Due to the low volatility of Fischer-Tropsch materials used in the formulations of the invention, Noack volatility values of 10 or less may be achieved.

The present invention may be further illustrated by the following example which is not intended, however, to represent a limitation on the scope of the invention.

Example

Two Fischer-Tropsch waxes were made with either iron-based or cobalt-based Fischer-Tropsch catalyst. They had the properties shown in Table 2:

TABLE 2

| | Fischer-Tropsch Catalyst | |
|---|---|---|
| | Fe-Based | Co-Based |
| Total Nitrogen and Sulfur, ppm | less than 10 | less than 25 |
| Oxygen by Neutron Activation, wt % | 0.15 | 0.69 |
| Oil Content, D 721, wt % | <0.8 | 6.68 |
| Total Normal Paraffin, wt % by GC | 92.15 | 83.72 |
| D 6352 SIMDIST (wt %), ° F. | | |
| T0.5 | 784 | 129 |
| T5 | 853 | 568 |
| T10 | 875 | 625 |
| T20 | 914 | 674 |
| T30 | 941 | 717 |
| T40 | 968 | 756 |
| T50 | 995 | 792 |
| T60 | 1013 | 827 |
| T70 | 1031 | 873 |
| T80 | 1051 | 914 |
| T90 | 1081 | 965 |
| T95 | 1107 | 1005 |
| T99.5 | 1133 | 1090 |

Four different Fischer-Tropsch derived products were made by hydroisomerizing the Fischer-Tropsch waxes from Table 2 over Pt/SAPO-11 on an alumina support. Two of the products were made from the iron-based Fischer-Tropsch wax and two were made from the cobalt-based Fischer-Tropsch wax. The full range broad boiling isomerized wax products were subsequently separated by vacuum distillation. The properties of these four fractions are summarized in Table 3. FT-4.4 and FT-4.5 were hydroisomerized Fischer-Tropsch derived lubricant base oil distillate fractions and FT-8.0 and FT-9.8 were bottoms fractions. Note that the FT-9.8 had the 10% boiling point in its boiling range greater than 900° F. and had a pour point between about −15° C. and about 20° C.

TABLE 3

| Sample Properties | FT-4.4 | FT-4.5 | FT-8.0 | FT-9.8 |
|---|---|---|---|---|
| | Base Oil—Distillate Fractions | | Distillate Bottoms | |
| FT Wax | Co-Based | Fe-Based | Co-Based | Fe-Based |
| Viscosity at 100° C., cSt | 4.415 | 4.524 | 7.953 | 9.830 |
| Viscosity Index | 147 | 149 | 165 | 163 |
| Pour Point, ° C. | −12 | −17 | −12 | −12 |
| CCS Vis @ −35° C., cP | 2,079 | 2,090 | 13,627 | 28,850 |
| SIMDIST (wt %), ° F. | | | | |
| 5 | 743 | 716 | 824 | 911 |
| 10/30 | 753/726 | 732/792 | 830/877 | 921/936 |
| 50 | 823 | 843 | 919 | 971 |
| 70/90 | 868/929 | 883/917 | 977/1076 | 999/1050 |
| 95 | 949 | 929 | 1120 | 1074 |
| FIMS Analysis, wt % | | | | |
| Paraffins | 85.0 | 89.4 | 70.2 | 81.3 |
| Monocyclo-paraffins | 14.0 | 10.4 | 28.0 | 16.4 |
| Multicyclo-paraffins | 1.0 | 0.2 | 1.8 | 2.3 |
| Total | 100.0 | 100.0 | 100.0 | 100.0 |
| Methyl Branches per 100 Carbons | | | | 6.63 |
| N-Paraffins by GC, wt % | | | | Less than 2 |

Note that FT-9.8 meets the properties of the pour point depressing base oil blending component used to prepare blends of this invention. It has the preferred amount of methyl branching, n-paraffin composition, CCS VIS, 10% boiling point, and pour point. FT-8 does not meet the properties of the pour point reducing base oil blending component of this invention. It has a 10% boiling point well below 900° F.

Three different multigrade engine oil formulations were made using the Fischer-Tropsch derived base oils described above. The components of each of these engine oil formulations are shown in Table 4.

TABLE 4

| Component, wt % | Engine Oil 1 | Comparative Engine Oil 2 | Comparative Engine Oil 3 |
|---|---|---|---|
| SAE Grade | 0W-20 | 0W-20 | 5W-20 |
| FT-4.4 | 0 | 53.74 | 15.34 |
| FT-4.5 | 79.83 | 0 | 0 |
| FT-8 | 0 | 35.61 | 74.01 |
| FT-9.8 | 8.87 | 0 | 0 |
| GF-3 Additive #1 | 11.30 | 0 | 0 |
| GF-3 Additive #2 | 0 | 10.35 | 10.35 |
| PAMA PPD | 0 | 0.30 | 0.30 |
| TOTAL | 100.00 | 100.00 | 100.00 |

Comparative Engine Oils 2 and 3 contained a polyalkyl methacrylate (PAMA) pour point depressant, while Engine Oil 1 did not. None of the examples contained additional viscosity index improver, other than what may have been present in incidental amounts in the GF-3 additive packages.

The viscometric properties of these three engine oil formulations are summarized in Table 5.

TABLE 5

| Properties | Engine Oil 1 | Comparative Engine Oil 2 | Comparative Engine Oil 3 |
|---|---|---|---|
| Viscosity at 100° C. | 6.67 | 7.09 | 8.89 |
| Pour Point, ° C. | −43 | −43 | Not tested |
| MRV TP-1 @−40° C. | 12,400 | 71,156 | Not tested |
| Yield Stress | None | None | |
| MRV TP-1 @−35° C. | Not tested | Not tested | 176,400 |
| Yield Stress | | | 80 |
| Noack Volatility, Wt % | 9.0 | Not tested | Not tested |

Note the extremely low MRV TP-1 viscosity of Engine Oil 1. This result was surprising considering the engine oil formulation was made using a high viscosity bottoms product which would not be expected to have good low temperature properties. The results are especially surprising considering that no pour point depressant or viscosity index improver was added to the formulation. These excellent low temperature properties are believed to be related to (a) the high boiling point and particular branching properties of the pour point reducing base oil blending component, and (b) the desirable properties of the hydroisomerized Fischer-Tropsch lubricant base oil that were blended into the engine oil formulation.

What is claimed is:

1. A multigrade engine oil meeting the specifications for SAE J300 revised June 2001 requirements, said engine oil comprising:

(a) between about 15 to about 94.5 wt % of a hydroisomerized distillate Fischer-Tropsch base oil characterized by (i) a kinematic viscosity between about 2.5 and about 8 cSt at 100° C., (ii) at least about 3 wt % of the molecules having cycloparaffin functionality, and (iii) a ratio of weight percent molecules with monocycloparaffin functionality to weight percent of molecules with multicycloparaffin functionality greater than about 15;

(b) between about 0.5 to about 20 wt % of a pour point depressing base oil blending component prepared from an hydroisomerized bottoms material having an average degree of branching in the molecules between about 5 and about 9 alkyl-branches per 100 carbon atoms and wherein not more than 10 wt % boils below about 900° F.; and (c) between about 5 to about 30 wt % of an additive package designed to meet the specifications for ILSAC GF-3.

2. The multigrade engine oil of claim 1 wherein the additive package is designed to meet the specifications for ILSAC GF-4.

3. The multigrade engine oil of claim 1 wherein the additive package contains less than about 1.00 wt % zinc expressed as elemental metal.

4. The multigrade engine oil of claim 1 wherein the additive package contains less than about 0.90 wt % phosphorus expressed as elemental metal.

5. The multigrade engine oil of claim 1 meeting the specifications for SAE viscosity grade 0W-XX, 5W-XX, or 10W-XX engine oil, wherein XX represents the integer 20, 30, or 40.

6. The multigrade engine oil of claim 5 meeting the specifications for SAE viscosity grade 0W-20.

7. The multigrade engine oil of claim 1 having a MRV TP-1 result of less than 60,000 cP at −30° C.

8. The multigrade engine oil of claim 7 having a MRV TP-1 result of less than 60,000 cP at −35° C.

9. The multigrade engine oil of claim 8 having a MRV TP-1 result of less than 60,000 cP at −40° C.

10. The multigrade engine oil of claim 9 having a MRV TP-1 result of less than 30,000 cP at −40° C.

11. The multigrade engine oil of claim 10 having a MRV TP-1 result of less than 15,000 cP at −40° C.

12. The multigrade engine oil of claim 1 having a Noack volatility value of about 15% or less.

13. The multigrade engine oil of claim 12 having a Noack volatility value of about 10% or less.

14. The multigrade engine oil of claim 1 wherein the hydroisomerized distillate Fischer-Tropsch base oil is characterized by at least about 10 wt % of the molecules having cycloparaffin functionality.

15. The multigrade engine oil of claim 1 wherein hydroisomerized distillate Fischer-Tropsch base oil is characterized by the ratio of weight percent of molecules with monocycloparaffin functionality to weight percent of molecules with multicycloparaffin functionality of greater than about 50.

16. The multigrade engine oil of claim 1 wherein the hydroisomerized distillate base oil contains less than about 0.3 wt % aromatics.

17. The multigrade engine oil of claim 1 wherein the hydroisomerized distillate base oil contains olefins in an amount which is undetectable by long duration carbon-13 NMR.

18. The multigrade engine oil of claim 1 wherein the pour point depressing base oil blending component is derived from an isomerized Fischer-Tropsch derived bottoms product having a molecular weight between about 600 and about 1,100.

19. The multigrade engine oil of claim 1 wherein the pour point depressing base oil blending component is an isomerized petroleum derived bottoms product having an average molecular weight of at least 600.

20. The multigrade engine oil of claim 1 wherein the pour point depressing base oil blending component has an average degree of branching in the molecules between about 6 and about 8 alkyl-branches per 100 carbon atoms.

21. The multigrade engine oil of claim 1 further comprising from about 5 wt % to about 70 wt % of a polymerized olefin selected from at least one of a polyalphaolefin base oil, a polyinternalolefin base oil, or a mixture of polyalphaolefin and polyinternalolefin base oils.

22. The multigrade engine oil of claim 1 containing no additional pour point depressant additive or viscosity index improver.

23. A process for preparing a multigrade engine oil meeting the specifications for SAE J300 revised June 2001 requirements which comprises:

(a) hydroisomerizing a waxy Fischer-Tropsch base oil in an isomerization zone in the presence of a hydroisomerization catalyst and hydrogen under pre-selected conditions determined to provide a hydroisomerized Fischer-Tropsch base oil product;

(b) recovering from the isomerization zone a hydroisomerized Fischer-Tropsch base oil product;

(c) distilling the hydroisomerized Fischer-Tropsch base oil product recovered from the isomerization zone under distillation conditions pre-selected to collect a distillate Fischer-Tropsch base oil characterized by (i) a kinematic viscosity between about 2.5 and about 8 cSt at 100° C., (ii) at least about 3 wt % of the molecules having cycloparaffin functionality, and (iii) a ratio of weight percent molecules with monocycloparaffin functionality to weight percent of molecules with multicycloparaffin functionality greater than about 15;

(d) blending the distillate Fischer-Tropsch base oil with (i) a pour point depressing base oil blending component prepared from an hydroisomerized bottoms material having an average degree of branching in the molecules between about 5 and about 9 alkyl-branches per 100 carbon atoms and wherein not more than 10 wt % boils below about 900° F. and (ii) an additive package designed to meet the specifications for ILSAC GF-3 in the proper proportions to yield a multigrade engine oil meeting the specifications for SAE J300 revised June 2001.

24. The process of claim 23 including the additional step of hydrofinishing the hydroisomerized Fischer-Tropsch base oil product wherein aromatics comprise no more than 0.3 wt % of the hydroisomerized Fischer-Tropsch base oil and the amount of olefins are undetectable by long duration carbon-13 NMR.

25. The process of claim 23 wherein the distillate Fischer-Tropsch base oil has a viscosity index equal to or greater than the viscosity index calculated by the equation:

$$VI=28\times Ln(\text{kinematic viscosity at } 100^\circ \text{ C.})+95$$

Wherein: VI represents viscosity index

Ln represents the natural log.

26. The process of claim 23 wherein the distillate Fischer-Tropsch base oil has a cold cranking simulator viscosity at −35° C. equal to or less than a value calculated by the equation:

$$CCS\ VIS(-35^\circ \text{ C.})=38\times(\text{kinematic viscosity at } 100^\circ \text{ C.})^3$$

Wherein: CCS VIS(−35° C.) represents cold cranking simulator viscosity at −35° C.

27. The process of claim 26 wherein the distillate Fischer-Tropsch base oil has a cold cranking simulator viscosity at −35° C. equal to or less than a value calculated by the equation:

$$CCS\ VIS(-35^\circ \text{ C.})=38\times(\text{kinematic viscosity at } 100^\circ \text{ C.})^{2.8}$$

Wherein: CCS VIS(−35° C.) represents cold cranking simulator viscosity at −35° C.

28. The process of claim 23 wherein the pour point depressing base oil blending component has a molecular weight of at least 600.

29. The process of claim 23 wherein the pour point depressing base oil blending component has an average degree of branching in the molecules between about 6 and about 8 alkyl-branches per 100 carbon atoms.

30. The process of claim 23 wherein sufficient pour point depressing base oil blending component is blended into the multigrade engine oil to lower the pour point of the distillate Fischer-Tropsch base oil by at least 2° C.

31. The process of claim 23 wherein the additive package is designed to meet the specifications for ILSAC GF-4.

32. The process of claim 23 wherein the distillate Fischer-Tropsch base oil is blended with the pour point depressing base oil blending component and additive package in the proper proportions to yield a multigrade engine oil having a MRV TP-1 result of less than 60,000 cP at −30° C.

33. The process of claim 32 wherein the distillate Fischer-Tropsch base oil is blended with the pour point depressing base oil blending component and additive package in the proper proportions to yield a multigrade engine oil having a MRV TP-1 result of less than 60,000 cP at −35° C.

34. The process of claim 33 wherein the distillate Fischer-Tropsch base oil is blended with the pour point depressing base oil blending component and additive package in the proper proportions to yield a multigrade engine oil having a MRV TP-1 result of less than 60,000 cP at −40° C.

35. The process of claim 34 wherein the distillate Fischer-Tropsch base oil is blended with the pour point depressing base oil blending component and additive package in the proper proportions to yield a multigrade engine oil having a MRV TP-1 result of less than 30,000 cP at −40° C.

36. The process of claim 35 wherein the distillate Fischer-Tropsch base oil is blended with the pour point depressing base oil blending component and additive package in the proper proportions to yield a multigrade engine oil having a MRV TP-1 result of less than 15,000 cP at −40° C.

* * * * *